US010247456B2

(12) United States Patent
Gov et al.

(10) Patent No.: US 10,247,456 B2
(45) Date of Patent: Apr. 2, 2019

(54) INTEGRATED RECEIVER AND SUCTION LINE HEAT EXCHANGER FOR REFRIGERANT SYSTEMS

(71) Applicant: HONEYWELL INTERNATIONAL INC., Morristown, NJ (US)

(72) Inventors: Ricky Gov, Monterey Park, CA (US); Ranjit Darke, San Francisco, CA (US); Peter Zheng, Rancho Palos Verdes, CA (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 265 days.

(21) Appl. No.: 14/921,260

(22) Filed: Oct. 23, 2015

(65) Prior Publication Data

US 2016/0091232 A1 Mar. 31, 2016

Related U.S. Application Data

(62) Division of application No. 12/912,965, filed on Oct. 27, 2010, now abandoned.

(51) Int. Cl.
*F25B 40/00* (2006.01)
*F25B 43/00* (2006.01)

(52) U.S. Cl.
CPC ..... *F25B 43/006* (2013.01); *F25B 40/00* (2013.01); *F25B 2400/053* (2013.01); *F25B 2400/054* (2013.01); *F25B 2400/16* (2013.01)

(58) Field of Classification Search
CPC .... F25B 43/006; F25B 40/00; F25B 2400/16; F25B 2400/054; F25B 2400/053; F28D 7/02; F28D 7/04; F28F 2225/02; F28F 2009/226
USPC ..... 165/163, 159, 162
See application file for complete search history.

(56) References Cited

U.S. PATENT DOCUMENTS 2,183,160 A * 12/1939 Cox ..... F28D 7/1646 165/159
2,365,878 A * 12/1944 Huff ..... B01J 8/067 165/163
2,520,045 A 1/1947 McGrath
2,502,675 A * 4/1950 Simpelaar ..... F28D 7/06 165/159
2,627,730 A 2/1953 Zearfoss
2,986,899 A 6/1961 Schenk
(Continued)

FOREIGN PATENT DOCUMENTS

CN 1864038 A 11/2006
CN 1878991 A 12/2006
(Continued)

OTHER PUBLICATIONS

EP search report, dated May 14, 2014, EP 11 18 5692.8.
(Continued)

*Primary Examiner* — Kun Kai Ma
(74) *Attorney, Agent, or Firm* — Shimokaji IP

(57) ABSTRACT

A receiver for a refrigeration system includes an enclosure with an inlet for liquid refrigerant at a first end and an outlet for the liquid refrigerant at a second end. A heat exchanger with an inlet and an outlet for refrigerant vapor is surrounded by the enclosure. The heat exchanger includes baffles so that alternatingly positioned flow passages are positioned on opposing sides of the enclosure.

12 Claims, 5 Drawing Sheets

(56) References Cited

U.S. PATENT DOCUMENTS

| | | | | |
|---|---|---|---|---|
| 3,110,164 | A | 11/1963 | Smith | |
| 3,155,158 | A * | 11/1964 | Peters | F22D 1/32 165/161 |
| 3,283,524 | A | 11/1966 | Byron | |
| 3,321,013 | A * | 5/1967 | Babylon | F28D 7/08 165/158 |
| 4,183,401 | A * | 1/1980 | Bell, Jr. | F28F 9/0131 165/159 |
| 4,249,596 | A * | 2/1981 | Tutak | B01D 5/0009 165/113 |
| 4,344,479 | A | 8/1982 | Bailey | |
| 4,537,045 | A | 8/1985 | Mayer | |
| 4,834,173 | A * | 5/1989 | Weiss | F28F 9/22 165/159 |
| 5,050,400 | A | 9/1991 | Lamment | |
| 5,233,842 | A | 8/1993 | Manning | |
| 5,479,790 | A | 1/1996 | Bottum | |
| 5,946,925 | A | 9/1999 | Williams | |
| 6,253,572 | B1 | 7/2001 | Bottum | |
| 6,314,752 | B1 * | 11/2001 | Christensen | F25B 15/00 62/484 |
| 6,463,757 | B1 | 10/2002 | Dickson | |
| 6,681,597 | B1 | 1/2004 | Yee | |
| 7,337,769 | B2 * | 3/2008 | Yi | F02B 29/0456 123/563 |
| 7,779,898 | B2 * | 8/2010 | Morrison | F28C 1/14 165/150 |
| 2001/0018962 | A1 * | 9/2001 | Joshi | F28D 7/06 165/11.1 |
| 2003/0024266 | A1 | 2/2003 | Zhang | |
| 2003/0116306 | A1 | 6/2003 | Besik | |
| 2006/0107671 | A1 | 5/2006 | Yoshida | |
| 2006/0169446 | A1 * | 8/2006 | Chien | F28D 7/08 165/163 |
| 2006/0225459 | A1 | 10/2006 | Meyer | |
| 2007/0256432 | A1 | 11/2007 | Zugibe | |
| 2010/0018246 | A1 * | 1/2010 | Wolfe, IV | F28D 7/024 62/513 |

FOREIGN PATENT DOCUMENTS

| | | | |
|---|---|---|---|
| DE | 102006016230 | A1 | 10/2006 |
| EP | 1396689 | A1 | 10/2004 |
| FR | 2083547 | | 12/1971 |
| FR | 2083547 | A1 | 12/1971 |
| SU | 859774 | | 8/1981 |
| SU | 859774 | A1 | 8/1981 |

OTHER PUBLICATIONS

CN search report, dated Nov. 28, 2014, application No. 201110404342.6.

CN search report, dated Jul. 3, 2015 , application No. 201110404342.6.

CN decision, dated Jan. 22, 2017 , application No. 201110404342.6.

CN notice of reexamination, dated Nov. 29, 2017 , application No. 201110404342.6.

EP examination report, dated Aug. 7, 2018, application No. 11185692.8.

* cited by examiner

INTEGRATED RECEIVER AND SUCTION LINE HEAT EXCHANGER FOR REFRIGERANT SYSTEMS

BACKGROUND OF THE INVENTION

The present invention generally relates to refrigeration systems. More particularly, the invention relates to a compact refrigeration system which may be advantageously employed in a vehicle.

In some vehicles such as aircraft, refrigeration systems may be employed to perform various cooling functions. In a typical aircraft, where space is limited, it is advantageous to construct on-board refrigeration systems that occupy as little volume as possible. At the same time, it is advantageous to construct aircraft refrigeration systems with low weight and high efficiency.

It is known that incorporating suction line heat exchangers in refrigeration systems may increase temperature of refrigerant vapor at a compressor inlet. The increased temperature may reduce the amount of refrigerant that can be absorbed into lubricating oil and thereby may result in an increase of viscosity of the oil. Higher viscosity oil-refrigerant mixture may provide improved lubrication and longer life for various compressor components. Additionally, the suction line heat exchanger may minimize the amount of liquid refrigerant that enters the compressor thus adding further to higher oil viscosity.

While suction line heat exchangers are a desirable feature for refrigeration systems, their use has heretofore added substantial volume to a refrigeration system. Typically, effective suction line heat exchangers may have a volume that is about equal to the volume of a receiver of the system.

As can be seen, there is a need for an aircraft refrigeration system system in which a suction line heat exchanger may be employed and in which the suction line heat exchanger adds only minimal volume to the system.

SUMMARY OF THE INVENTION

In one aspect of the present invention, a distributed cooling system for an aircraft may comprise an evaporator; a compressor; a condenser; and a receiver interposed between the condenser and the evaporator for receiving liquid refrigerant from the condenser, the receiver comprising a heat exchanger; and the heat exchanger interposed between the evaporator and the compressor and configured to transfer heat from the liquid refrigerant in the receiver to refrigerant vapor emerging from the evaporator.

In another aspect of the present invention, a receiver for a refrigeration system may comprise an enclosure with an inlet for liquid refrigerant at a first end and an outlet for the liquid refrigerant at a second end; and a heat exchanger with an inlet and an outlet for refrigerant vapor; and wherein the heat exchanger is surrounded by the enclosure.

In still another aspect of the present invention, a method for improving operation of a refrigeration system may comprise passing a vapor and liquid mixture emerging from an evaporator through a heat exchanger incorporated in a receiver; passing heated liquid refrigerant into the receiver and into contact with the heat exchanger; transferring heat from the liquid refrigerant to the vapor; and passing the heated mixture to an inlet of a compressor.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features.

The present invention generally provides a cooling system that uses a space-saving receiver and an integral suction-line heat exchanger incorporated into a single enclosure.

Figure 1:
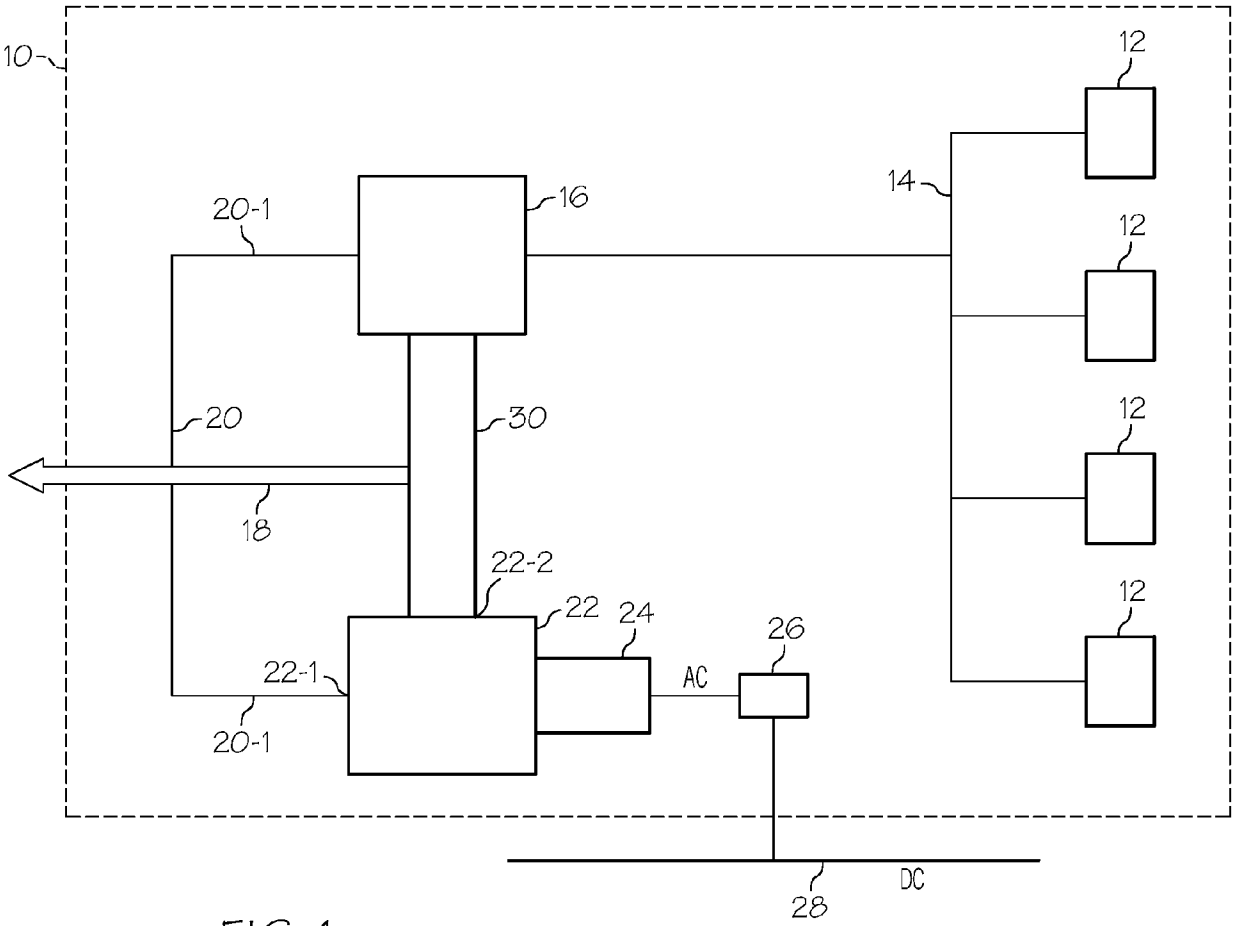
FIG. 1 is a block diagram of a distributed cooling system in accordance with an embodiment of the invention.

Referring now to FIG. 1, a distributed cooling system 10 is shown in block diagram format. In an exemplary embodiment of the invention, the system 10 may comprise a plurality of cooled storage boxes 12 which may be used for storing food and beverage on a commercial aircraft (not shown). In the system 10, heat from the boxes 12 may be extracted through a fluid-filled cooling circuit 14 and conveyed to an evaporator 16. The evaporator 16 may extract heat from the cooling circuit 14 and heated air may be exhausted from the aircraft though an exhaust passage 18.

A refrigerant circuit 20 may interconnect the evaporator 16 to a compressor 22 at an inlet side 22-1. In an exemplary embodiment of the invention, the compressor 22 may be a scroll compressor. The compressor 22 may be driven by an AC motor 24 which may be provided with electrical power through a dedicated inverter 26 which may be connected to a DC bus 28 of the aircraft. The compressor 22 may be interconnected, at an outlet side 22-2, to the evaporator 16 through a condenser 30. A receiver 31 may be interposed between the condenser 30 and the evaporator 16.

Figure 2:
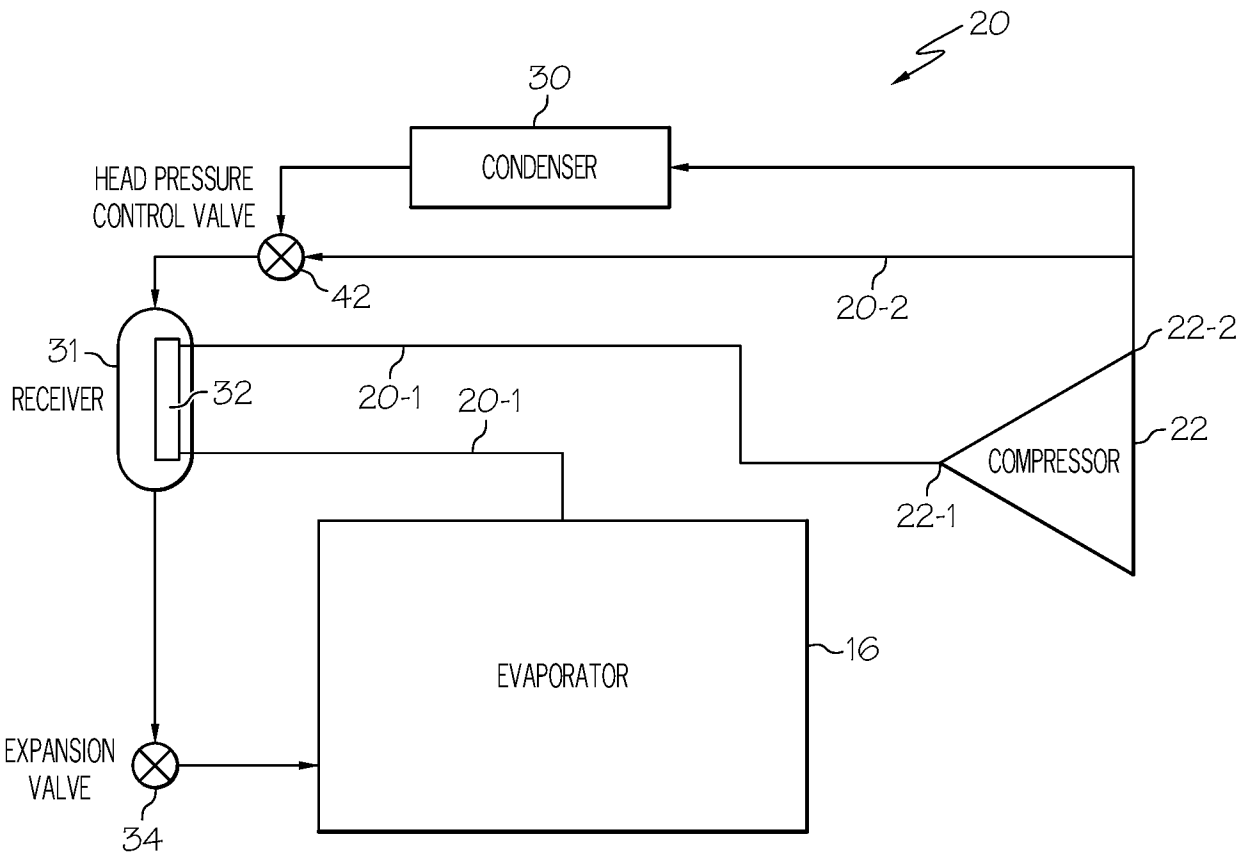
FIG. 2 is a schematic diagram of a refrigeration system in accordance with an embodiment of the invention.

Referring now to FIG. 2, a schematic diagram of an exemplary embodiment of the refrigerant circuit 20 is illustrated. The circuit 20 may interconnect the compressor 22, the condenser 30, the receiver 31, an expansion valve 34 and the evaporator 16. In the exemplary embodiment of the refrigerant circuit 20, the receiver 31 may incorporate a suction line heat exchanger 32.

Figure 3:
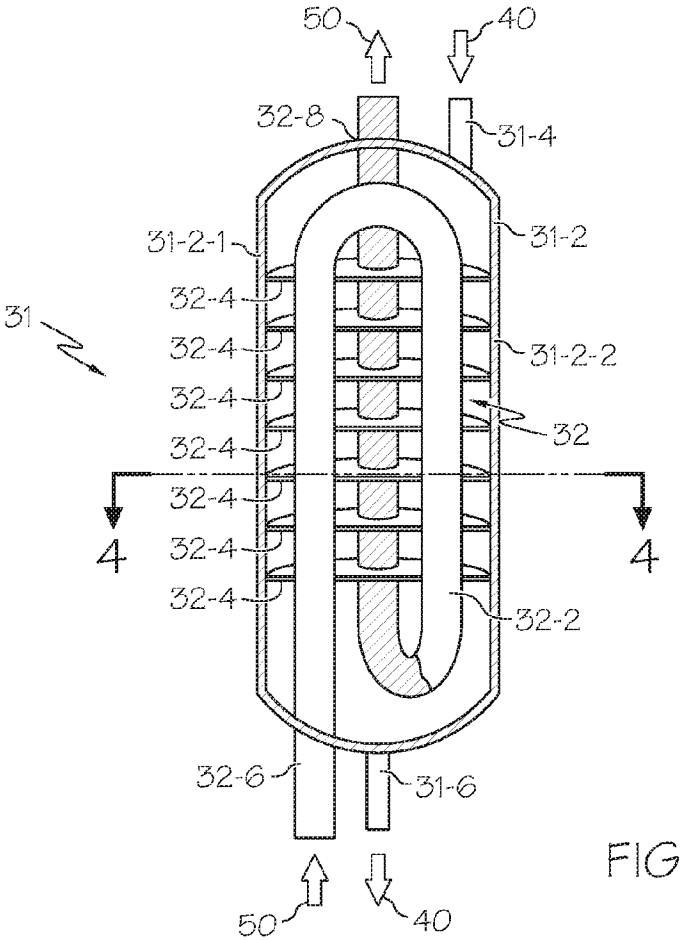
FIG. 3 is sectional view of a receiver in accordance with an embodiment of the invention.

Referring now to FIGS. 2 and 3, an exemplary embodiment of the receiver 31 may be illustrated in detail. The receiver 31 may comprise an enclosure 31-2, an inlet 31-4 and an outlet 31-6. Liquid refrigerant 40 may enter the receiver 31 through the inlet 31-4 and exit through the outlet 31-6. In operation, the receiver 31 may collect varying amounts of the liquid refrigerant 40. A head-pressure control valve 42 (See FIG. 2) may be employed to control pressure in the condenser 30. This pressure control may be accomplished by by-passing varying amounts of the liquid refrigerant 40 directly from the compressor 22 into the receiver 31. It may be seen, by referring back to FIG. 2, that the liquid refrigerant 40 may enter the receiver 31 as by-passed refrigerant, through a bypass line 20-2 and/or as refrigerant directly from the condenser 30. In either case, the liquid refrigerant 40 may collect in the receiver 31 until it is released though the expansion valve 34. In accordance with the present invention, the liquid refrigerant 40 passing through and/or collected in the receiver 41 may be used as a heat source for the heat exchanger 32.

In an exemplary embodiment, the heat exchanger 32 may comprise a serpentine tube 32-2 and a plurality of baffles 32-4. The heat exchanger 32 may be positioned within the enclosure 31-2. The heat exchanger 32 may be interposed between the evaporator 16 and the inlet 22-1 of the compressor 22 on a suction line 20-1. Refrigerant vapor may be comingled with lubricating oil and liquid refrigerant as it emerges from the evaporator 16. This mixture of lubricating oil, refrigerant vapor and liquid refrigerant may be referred as a suction-line mixture 50. The mixture 50 from the evaporator 16 may enter the heat exchanger 32 at an inlet 32-6 and may exit at an outlet 32-8. The mixture 50 may pass through the tube 32-2 and the liquid refrigerant 40 may pass over the baffles 32-4. The liquid refrigerant 40 may transfer heat to the baffles 32-4 and the tube 32-2 and the mixture 50. This transfer of heat may raise the temperature of the mixture 50 as it passes through the heat exchanger 32 and into the compressor 20.

The heat exchanger 32 may advantageously heat the mixture 50 sufficiently to vaporize any liquid refrigerant that may be contained in the mixture 50 so that any refrigerant emerging from the heat exchanger may be in a vapor state. Additionally, because the heat exchanger 32 may advantageously raise the temperature of the mixture 50, viscosity of an oil-refrigerant component of the mixture may be increased. This may occur because the oil-refrigerant component may become modified to have a higher fraction of oil. Higher viscosity oil-refrigerant may provide improved lubrication and longer life for various compressor components. It may also be noted that because the heat exchanger 32 may minimize the amount of liquid refrigerant that enters the compressor 22, resultant oil viscosity may be increased.

Figure 5:
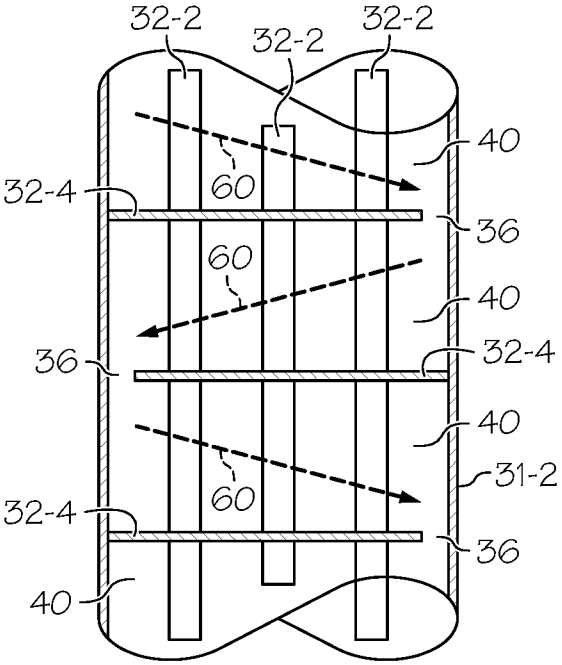
FIG. 5 is a partial sectional view of the receiver of FIG. 3 showing a flow path in accordance with an embodiment of the invention.
Figure 4:
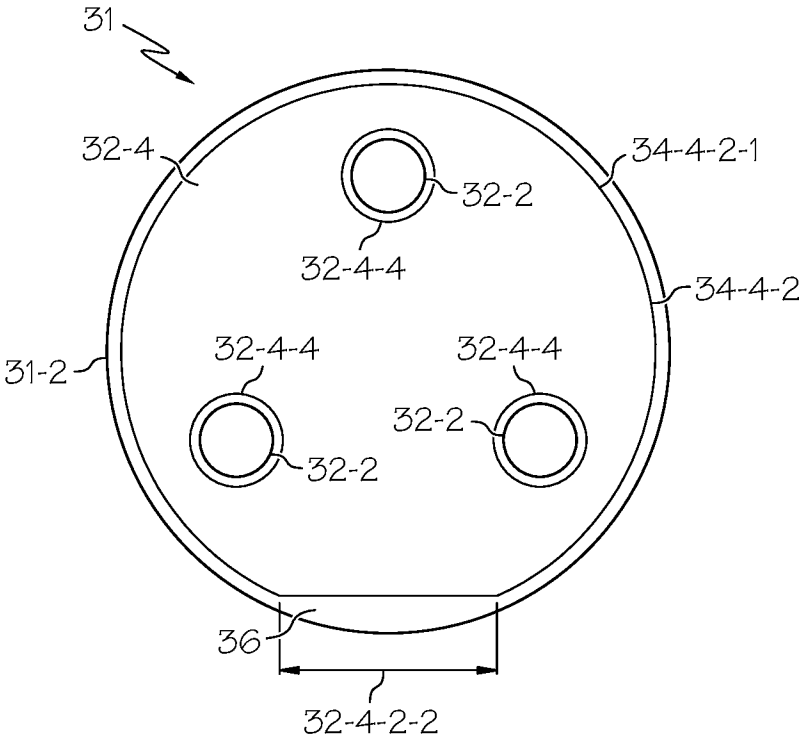
FIG. 4 is a sectional view of the receiver of FIG. 3 taken along the line 4-4 in accordance with an embodiment of the invention.

Referring now to FIGS. 4 and 5, it may be seen that the baffles 32-4 may advantageously distribute the liquid refrigerant 40 throughout the volume of the enclosure 31-2 as the refrigerant 40 flows into and/or through the receiver 31. One or more of the baffles 32-4 may comprise a flat disc with an outer periphery 32-4-2 that may partially conform to an exemplary cylindrical configuration of the enclosure 31-2 of the receiver. The outer periphery 31-2 may be shaped so that a portion 32-4-2-2 of the periphery 34-4-2 may not conform to the shape of the enclosure 31-2. When one or more of the baffles 32-4 may be installed in the enclosure 31-2, a conforming portion 34-4-2-1 of the outer periphery 34-4-2 of the baffle may be in contact with the enclosure and a flow through passage 36 may develop between the non-contact, non-conforming portion 32-4-2-2 and the enclosure 31-2. The baffles 32-4 may also be provided with holes 32-4-4 into which the tube 32-2 may be snugly fit in contact with the baffle 32-4.

Referring particularly to FIG. 5, it may be seen that the baffles 32-4 may be installed in the enclosure 31-2 so that the flow passages 36 may be positioned on opposing sides of the enclosure 31-2. In the exemplary embodiment of the receiver 31 shown in FIG. 5, the liquid refrigerant 40 may flow across a first one of the baffles 32-4 and into one of the flow passages on a right side 31-2-2 of the enclosure 31-2. A successive one of the baffles 32-4 may be installed so that its respective flow passage 36 may be on a left side 31-2-1 of the enclosure 31-2. Consequently, the liquid refrigerant 40 may flow from the right side of the enclosure 31-2, across the successive baffle 32-4 and into the flow passage 36 on the left side of the enclosure 31-2. It may be seen that as the liquid refrigerant 40 may flow, along a flow path 60, through alternatingly positioned flow passages 36, the liquid refrigerant 40 may advantageously pass into contact with the tube 32-2 on numerous occasions, thus effectively transferring heat to the tube 32-2 and the mixture 50.

Figure 6:
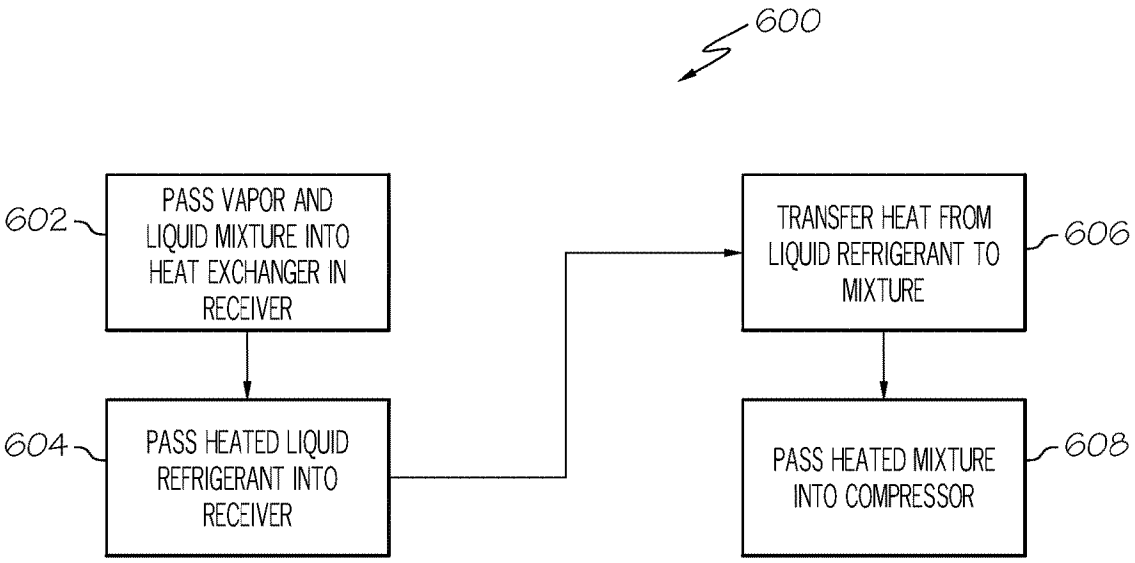
FIG. 6 is a flow chart of a method for improving operation of a refrigeration system in accordance with an embodiment of the invention.

Referring now to FIG. 6, an exemplary method 600 may be employed to improve operation of a refrigeration system. In a step 602, a vapor and liquid mixture emerging from an evaporator may be passed through a heat exchanger incorporated in a receiver (e.g., the mixture 50 may be passed from the evaporator 16 through the suction line 20-1 into the exchanger 32). In a step 604 heated liquid refrigerant may be passed into a receiver and into contact with the heat exchanger (e.g., the liquid refrigerant 40 emerging from the head pressure control valve 42 may be passed into and through the receiver 31). In a step 606, heat may be transferred from the liquid refrigerant to the vapor and liquid mixture (e.g., as the liquid refrigerant passes across the tube 32-4, heat may be transferred into the tube 32-4 and that transferred heat may be transferred to the mixture 59 as it passes through the tube 32-4). In a step 608, the heated mixture may be passed to an inlet of a compressor (e.g., the mixture 50 may emerge from the heat exchanger 32 and travel to the inlet 22-1 of the compressor 22).

It should be understood, of course, that the foregoing relates to exemplary embodiments of the invention and that modifications may be made without departing from the spirit and scope of the invention as set forth in the following claims.

We claim:

1. A receiver for a refrigeration system comprising:

an enclosure for collecting liquid refrigerant, the enclosure having an inlet for the liquid refrigerant at and through a first end and an outlet for the liquid refrigerant at and through a second end, the first end and the second end being at opposing distal ends of the enclosure, the distal ends each having a concave shape that extends outward from an interior of the enclosure in a direction of their respective inlet and outlet;

a heat exchanger with an exchanger inlet and an exchanger outlet for receiving at least refrigerant vapor and transferring heat from the liquid refrigerant to the refrigerant vapor, the exchanger inlet being disposed at and through the second end and the exchanger outlet being disposed at and through the first end, a cross-section of the exchanger outlet and a cross-section of the exchanger inlet are each wider than a cross-section of the inlet and a cross-section of the outlet of the enclosure;

wherein the heat exchanger is surrounded by the enclosure;

wherein the heat exchanger includes:

a serpentine tube for passage of at least refrigerant vapor through the enclosure from the second end to the first end;

baffles that define a flow path for the liquid refrigerant through the receiver;

wherein the baffles are in a stacked configuration with only the serpentine tube between adjacent baffles; and wherein the flow path is constrained to a zig-zag configuration among the baffles.

2. The receiver of claim 1 wherein each baffle has an outer periphery, a first portion of which conforms in shape to a shape of an interior of the enclosure and a second portion of which does not conform to the shape of the interior of the enclosure so that the flow path for the liquid refrigerant is present in a space between the second portion of the outer periphery and the interior of the enclosure.

3. The receiver of claim 2 wherein the first portion of the outer periphery of the baffle is in contact with the interior of the enclosure so that flow of the liquid refrigerant is directed to the flow path.

4. The receiver of claim 2, wherein the baffles are provided with one or more holes through which the tube passes.

5. The receiver of claim 4 wherein the tube is in contact with the baffles at the one or more holes so that flow of the liquid refrigerant is directed to the flow path.

6. A receiver for a refrigeration system comprising:

an enclosure with an inlet for liquid refrigerant at and through a first end and an outlet for the liquid refrigerant at and through a second end, the first and second ends each having a concave shape that extends outward from an interior of the enclosure toward their respective inlet and outlet; and a heat exchanger with an exchanger inlet and an exchanger outlet for at least refrigerant vapor to transfer heat from the liquid refrigerant to the refrigerant vapor, the exchanger inlet being formed on the concave shape of the second end, the exchanger outlet being formed on the concave shape of the first end;

wherein the heat exchanger is surrounded by the enclosure, and wherein the heat exchanger includes:

a tube for passage of at least the refrigerant vapor, the tube having a cross-section that is wider than a cross-section of the inlet and a cross-section of the outlet of the enclosure; and stack baffles with planar surfaces so that the liquid refrigerant flows on and across the planar surfaces, from one baffle to a next baffle, in alternating opposite directions, each stack baffle having no more than three holes for receiving the tube;

wherein the tube includes a plurality of straight portions joined by bend portions, each straight portion extending through the holes in every stack baffle within the enclosure;

wherein there is only the tube between the planar surfaces of adjacent baffles.

7. The receiver of claim 6 wherein the tube is a serpentine tube.

8. The receiver of claim 6 wherein each stack baffle has an outer periphery, a first portion of which conforms in shape to a shape of an interior of the enclosure and a second portion of which does not conform to the shape of the interior of the enclosure so that a flow passage for the liquid refrigerant is present in a space between the second portion of the outer periphery and the interior of the enclosure.

9. The receiver of claim 8 wherein the first portion of the outer periphery of the stack baffles is in contact with the interior of the enclosure so that flow of the liquid refrigerant is directed to the flow passage.

10. The receiver of claim 8, wherein the stack baffles are provided with one or more holes through which the tube passes.

11. The receiver of claim 10 wherein the tube is in contact with the stack baffles at the one or more holes so that flow of the liquid refrigerant is directed to the flow passage.

12. The receiver of claim 11 further comprising:

at least two of the stack baffles; and wherein a first one of the flow passages formed by a first one of the at least two stack baffles is at a first side of the enclosure; and wherein a second one of the flow passages formed by a second one of the at least two stack baffles is at a second side of the enclosure so that the liquid refrigerant is constrained to flow from the first side of the enclosure to the second side of the enclosure to effectively transfer heat to the tube.

* * * * *